US010046384B2

(12) United States Patent
Keown et al.

(10) Patent No.: US 10,046,384 B2
(45) Date of Patent: Aug. 14, 2018

(54) SIDE DAM WITH POCKET

(71) Applicant: NUCOR CORPORATION, Charlotte, NC (US)

(72) Inventors: Kevin Keown, Blytheville, AR (US); Tao Wang, Blytheville, AR (US); Rama Ballav Mahapatra, Brighton-le-Sands (AU)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 15/258,055

(22) Filed: Sep. 7, 2016

(65) Prior Publication Data

US 2017/0087623 A1 Mar. 30, 2017

Related U.S. Application Data

(60) Provisional application No. 62/235,136, filed on Sep. 30, 2015.

(51) Int. Cl.
*B22D 11/06* (2006.01)

(52) U.S. Cl.
CPC ..... *B22D 11/066* (2013.01); *B22D 11/064* (2013.01); *B22D 11/0622* (2013.01); *B22D 11/0651* (2013.01)

(58) Field of Classification Search
CPC ... B22D 11/06; B22D 11/0622; B22D 11/064; B22D 11/0651; B22D 11/066
USPC ..... 164/428, 480
See application file for complete search history.

(56) References Cited

U.S. PATENT DOCUMENTS

| | | | |
|---|---|---|---|
| 4,885,264 | A | 12/1989 | Sindlhauser et al. |
| 4,913,408 | A | 4/1990 | Hoggard et al. |
| 4,960,734 | A | 10/1990 | Kanai et al. |
| 5,010,948 | A | 4/1991 | Blin et al. |
| 5,040,591 | A | 8/1991 | Riboud et al. |

(Continued)

FOREIGN PATENT DOCUMENTS

| | | |
|---|---|---|
| AU | 618836 | 3/1990 |
| EP | 0588743 | 11/1996 |

(Continued)

OTHER PUBLICATIONS

Australian Patent Office International-Type Search Report National Application No. 2012903316 dated Sep. 28, 2012.

(Continued)

*Primary Examiner* — Kevin P Kerns
(74) *Attorney, Agent, or Firm* — Hahn Loeser & Parks LLP

(57) ABSTRACT

A side dam for a continuous twin roll caster with a body of refractory material shaped to form a side dam and having edge portions adapted to engage end portions of casting rolls of a twin roll caster and having a nip portion adapted to be adjacent a nip between the casting rolls and having upper portions extending across the side dam to form a lateral restraint for a casting pool of molten metal during operation in the twin roll caster; and a pocket between 5 and 50 mm in depth formed in the body between the edge portions and forming shoulder portions in the body between the edge portions and the pocket adapted to be worn as a casting campaign continues until the pocket is reached and continuing to be worn away at level of base portions of the pocket until casting is completed.

17 Claims, 9 Drawing Sheets

(56) References Cited

U.S. PATENT DOCUMENTS

| | | | |
|---|---|---|---|
| 5,080,162 | A | 1/1992 | Blin et al. |
| 5,080,163 | A | 1/1992 | Blin |
| 5,117,896 | A | 6/1992 | Tavernin |
| 5,172,750 | A | 12/1992 | Birat et al. |
| 5,188,166 | A | 2/1993 | Perry |
| 5,286,685 | A | 2/1994 | Schoennahl et al. |
| 5,318,097 | A | 6/1994 | Blin et al. |
| 5,336,454 | A | 8/1994 | Montgomery |
| 5,389,587 | A | 2/1995 | Nakashima et al. |
| 5,390,726 | A | 2/1995 | Fukuda et al. |
| 5,401,696 | A | 3/1995 | Montgomery |
| 5,457,075 | A | 10/1995 | Fukushima et al. |
| 5,484,752 | A | 1/1996 | Waku et al. |
| 5,628,359 | A | 5/1997 | Legrand et al. |
| 5,638,892 | A | 6/1997 | Barbe et al. |
| 5,704,414 | A | 1/1998 | Breviere |
| 5,787,968 | A | 8/1998 | Lauener |
| 5,848,635 | A | 12/1998 | Aoi et al. |
| 5,908,795 | A | 6/1999 | Nishio et al. |
| 5,915,454 | A | 6/1999 | Wright et al. |
| 5,925,585 | A | 7/1999 | Schoennahl et al. |
| 5,927,375 | A | 7/1999 | Damasse et al. |
| 6,032,722 | A | 3/2000 | Russell et al. |
| 6,051,058 | A | 4/2000 | Crisci et al. |
| 6,079,480 | A | 6/2000 | Oka et al. |
| 6,082,437 | A | 7/2000 | Damasse et al. |
| 6,202,792 | B1 | 3/2001 | Cheong et al. |
| 6,237,673 | B1 | 5/2001 | Kato et al. |
| RE37,214 | E | 6/2001 | Barbe et al. |
| 6,257,315 | B1 | 7/2001 | Spink |
| 6,296,045 | B1 | 10/2001 | Fox et al. |
| 6,296,046 | B1 | 10/2001 | Jeong et al. |
| 6,354,365 | B2 | 3/2002 | Capotosti et al. |
| 6,363,999 | B1 | 4/2002 | Smith |
| 6,378,598 | B1 | 4/2002 | Tonelli et al. |
| 6,458,732 | B1 | 10/2002 | Doza et al. |
| 6,488,075 | B1 | 12/2002 | Breviere et al. |
| 6,497,270 | B1 | 12/2002 | Breviere et al. |
| 6,513,573 | B1 | 2/2003 | Guasto et al. |
| 6,588,492 | B1 | 7/2003 | Fish et al. |
| 6,739,382 | B2 | 5/2004 | De Luca et al. |
| 6,910,523 | B2 | 6/2005 | Fish et al. |
| 7,066,238 | B2 | 6/2006 | Hohenbichler et al. |
| 7,140,416 | B2 | 11/2006 | Bassarutti et al. |
| 7,147,035 | B2 | 12/2006 | Fish et al. |
| 7,208,433 | B2 | 4/2007 | Nose et al. |
| 7,234,509 | B2 | 6/2007 | Poloni et al. |
| 7,258,157 | B2 | 8/2007 | Damasse et al. |
| 7,337,827 | B2 | 3/2008 | Marti et al. |
| 7,556,084 | B2 | 7/2009 | Bowman et al. |
| 7,975,756 | B2 | 7/2011 | Bowman et al. |
| 8,034,153 | B2 | 10/2011 | Marchiando et al. |
| 8,042,601 | B2 | 10/2011 | Bowman et al. |
| 8,251,127 | B2 | 8/2012 | Ondrovic et al. |
| 8,499,820 | B2 | 8/2013 | Ondrovic et al. |
| 2007/0006990 | A1 | 1/2007 | Marti et al. |

FOREIGN PATENT DOCUMENTS

| | | | | |
|---|---|---|---|---|
| JP | 67094456 | | 11/1982 | |
| JP | 62166054 | | 7/1987 | |
| JP | 62-176647 | | 8/1987 | |
| JP | 62-176647 | A * | 8/1987 | ..... B22D 11/06 |
| JP | 7068352 | | 3/1995 | |
| WO | 1995013155 | | 5/1995 | |

OTHER PUBLICATIONS

U.S. Patent Office—U.S. Appl. No. 15/258,055, Side Dam With Pocket, filed Sep. 7, 2016.

* cited by examiner

SIDE DAM WITH POCKET

This nonprovisional application claims priority to U.S. Provisional Application No. 62/235,136, filed on Sep. 30, 2015, which is incorporated by reference in its entirety.

BACKGROUND AND SUMMARY

This invention relates to the casting of metal strip by continuous casting in a twin roll caster.

In a twin roll caster, molten metal is introduced between a pair of counter-rotated casting rolls that are cooled so that metal shells solidify on the moving roll surfaces and are brought together at a nip between them. The term "nip" is used herein to refer to the general region at which the rolls are closest together. The molten metal may be delivered from a ladle into a smaller vessel or series of smaller vessels from which it flows through a metal delivery nozzle located above the nip, forming a casting pool of molten metal supported on the casting surfaces of the rolls immediately above the nip and extending along the length of the nip. As the molten metal formed into shells are joined and pass through the nip between the casting rolls, a thin metal strip is cast downwardly from the nip.

The casting pool is usually confined between side dams held in sliding engagement with end portions of the casting rolls so as to constrain the two ends of the casting pool against outflow. Side dams at the end portions of the casting rolls inhibit leakage of molten metal from the casting pool and maintain the casting pool at a desired depth. As the casting rolls are rotated, the side dams experience frictional wear, causing arc-shaped grooves to form in the side dams along the circumferential end portions of the casting rolls. To compensate for this wear, the side dams are movable to gradually shift inward under compression forces while having the side dams biased against the ends portions of the casting rolls in order to provide a seal with the casting rolls.

During casting operations, the metal flow rate and molten metal temperature are controlled which reduce the formation of solidified steel skulls in the casting pool in the area where the side dams, casting rolls and meniscus of the casting pool intersect, i.e. the "triple point" region. These unwanted solidified steel skulls, also known as "snake eggs" in casting, may form from time to time and drop between the side dams and the casting rolls into the cast strip passing through the casting roll nip. When these skulls drop between the roll nip, they may cause the two solidifying shells at the casting roll nip to "swallow" additional liquid metal between the shells, and may cause the strip to reheat and break disrupting the continuous production of coiled strip.

Dropped skulls, or snake eggs, may be detected as visible bright bands across the width of the cast strip, as well as spikes in the lateral force exerted on the casting rolls as they pass through the roll nip. Such resistive forces are exerted against the side dams in addition to the forces generated by the ferrostatic head in the casting pool. Skulls resulting in snake eggs in the cast strip passing through the nip between the casting rolls may also cause lateral movement of the casting rolls and the side dams. To resist the increased forces generated, bias forces have been applied to the side dams. This increases the force the side dams exert on the end portions of the casting rolls, which in turn increases side dam wear. There remains, therefore, a need to control the formation of unwanted solidified skulls in the casting pool and to reduce the formation of snake eggs in the cast thin metal strip.

Disclosed is a side dam for a continuous twin roll caster that substantially reduces the formation of solidified skulls and snake eggs. The side dam comprises a body of refractory material shaped to form a side dam and having edge portions adapted to engage end portions of casting rolls of the twin roll caster and having a nip portion adapted to be adjacent a nip between the casting rolls, with upper portions extending across the side dam to form a lateral restraint for a casting pool of molten metal during operation in a twin roll caster. The side dam also comprises a pocket between 5 and 50 mm in depth formed in the body of the side dam between the edge portions of the body, and forming shoulder portions in the body between the edge portions of the body and the pocket adapted to be worn as a casting campaign continues until the pocket is reached and continuing to be worn away at level of base portions of the pocket until casting is completed.

The shoulder portions of the body may be between 10 to 20 mm in width. In some embodiments, the shoulder portions of the body of the side dam may be between 12 to 18 mm. The pocket formed in the body may be between 5 and 35 mm in depth or between 5 and 25 mm in depth. In some embodiments, the pocket formed in the body may be between 10 and 20 mm in depth.

Also disclosed is an apparatus for continuously casting metal strip comprising: (a) a pair of counter-rotatable casting rolls laterally positioned to form a nip there between through which thin strip can be cast; (b) a pair of side dams adjacent the end portions of casting rolls adapted to confine a casting pool of molten metal supported on casting surfaces on the casting rolls above the nip, each side dam having edge portions adapted to engage end portions of the casting rolls and having a nip portion adjacent a nip between the casting rolls and upper portions extending across the side dam to form a lateral restraint for the casting pool of molten metal during operation in a twin roll caster; (c) each side dam formed with a pocket between 5 and 50 mm in depth between the edge portions and with shoulder portions between the edge portions and the pocket adapted to be worn as a casting campaign continues until the pocket is reached and continuing to be worn away at level of base portions of the pocket until casting is completed; and (d) a metal delivery system disposed above the nip and capable of discharging molten metal to form the casting pool supported on the casting rolls.

Again, the shoulder portions of the body may be between 10 to 20 mm in width. In some embodiments, the shoulder portions of the body may be between 12 to 18 mm. The pocket formed in the body may be between 5 and 35 mm in depth or between 5 and 25 mm in depth. In some embodiments, the pocket formed in the body may be between 10 and 20 mm in depth.

DETAILED DESCRIPTION

Figure 1:
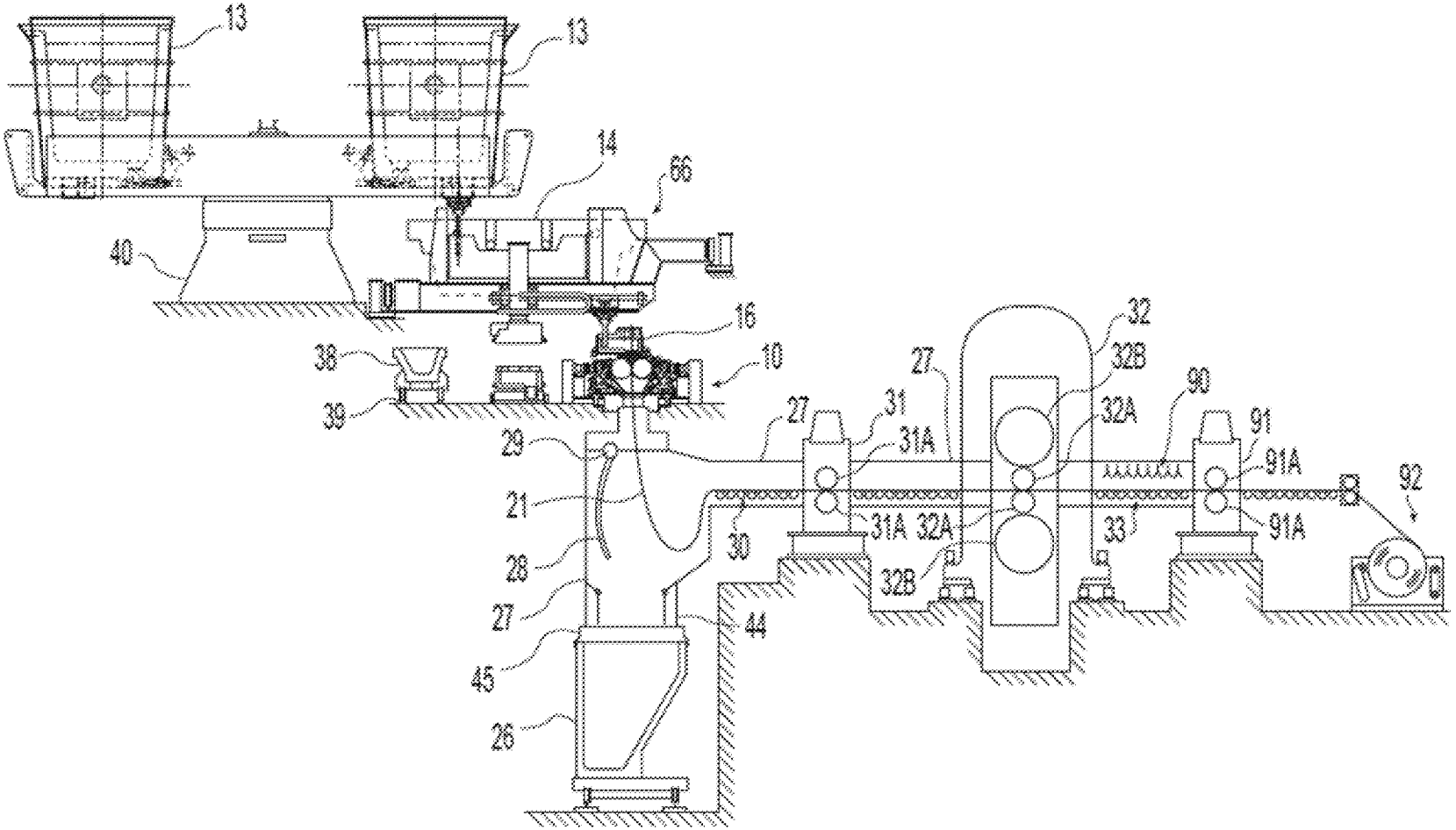
FIG. 1 is a diagrammatical side view of a twin roll caster of the present disclosure.
Figure 2:
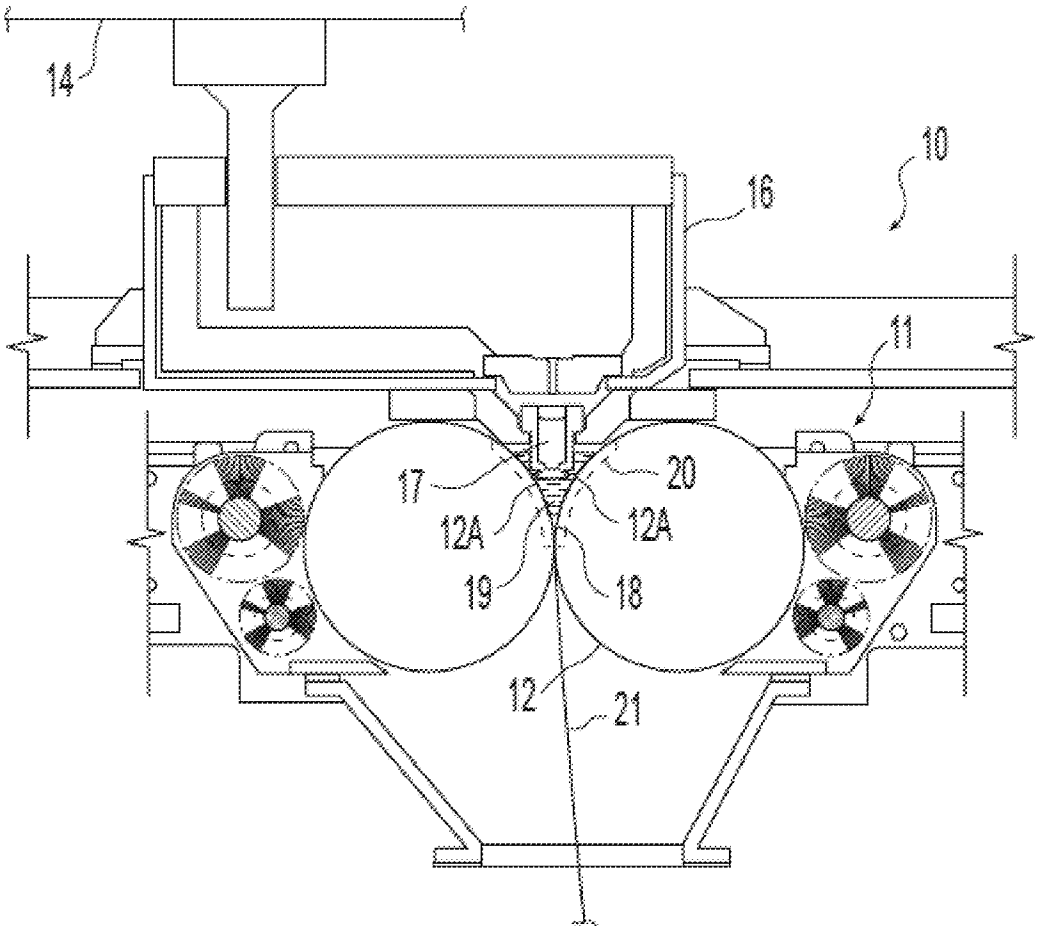
FIG. 2 is a partial cross-sectional view through a pair of casting rolls mounted in a continuous twin roll caster system.

Referring now to the drawings, there is illustrated in FIGS. 1 and 2 a portion of a twin roll caster for continuously casting thin steel strip that comprises a main machine frame 10 that that stands up from the factory floor and supports a roll cassette module 11 including a pair of counter-rotatable casting rolls 12 mounted therein. The casting rolls 12 having casting surfaces 12A laterally positioned to form a nip 18 there between. The casting rolls 12 are mounted in the roll cassette 11 for ease of operation and movement. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls for casting.

Molten metal is supplied from a ladle 13 through a metal delivery system including a movable tundish 14 and a transition piece or distributor 16, and the molten metal flows to at least one metal delivery nozzle 17, or core nozzle, positioned between the casting rolls 12 above the nip 18. Molten metal discharged from the delivery nozzle 17 forms a casting pool 19 of molten metal above the nip 18 supported on the casting surfaces 12A of the casting rolls 12. This casting pool 19 is laterally confined in the casting area at the ends of the casting rolls 12 by a pair of side closures or plate side dams 20 (shown in dotted line in FIG. 2). The upper surface of the casting pool 19 (generally referred to as the "meniscus" level) typically is above the bottom portion of the delivery nozzle 17 during casting with the lower part of the delivery nozzle 17 immersed in the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to deliver molten metal to the tundish. The movable tundish 14 may be positioned on a tundish car 66 capable of transferring the tundish from a heating station (not shown), where the tundish is preheated to near casting temperature, to the casting position. A tundish guide, such as rails, may be positioned beneath the tundish car 66 to enable moving the movable tundish 14 from the preheating station to the casting position.

The movable tundish 14 may be fitted with a slide gate (not shown), actuable by a servo mechanism, to allow molten metal to flow from the tundish 14 through the slide gate, and then through a refractory outlet shroud (not shown) to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting rolls move into and through the casting pool 19 with each revolution of the casting rolls 12. The shells are brought together at the nip 18 between the casting rolls 12 to produce solidified thin cast strip product 21 delivered downwardly from the nip 18. The gap between the casting rolls is such as to maintain separation between the solidified shells at the nip and form a semi-solid metal in the space between the shells through the nip, and is, at least in part, subsequently solidified between the solidified shells within the cast strip below the nip.

FIG. 1 shows the twin roll caster producing the thin cast strip 21, which passes across guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces corresponding to the desired strip profile across the work rolls. The hot rolled cast strip then passes onto a run-out table 33, where the strip is cooled by contact with a coolant, such as water, supplied via water jets 90 or other suitable means, and by convection and radiation. In any event, the hot rolled cast strip then passes through a second pinch roll stand 91 having rollers 91A to provide tension of the cast strip, and then to a coiler 92. The cast strip typically is between about 0.3 and 2.0 millimeters in thickness before hot rolling by hot rolling mill 32.

At the start of the casting operation, a short length of imperfect strip is typically produced as casting conditions stabilize. After continuous casting is established, the casting rolls are moved apart slightly and then brought together again to cause the leading end of the cast strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At then, a water-cooled apron 28 that normally hangs downwardly from a pivot 29 to one side in the enclosure 27 is swung into position to guide the clean end of the cast strip 21 onto the guide table 30 that feeds the strip to the pinch roll stand 31. The apron 28 is then retracted back to its hanging position to allow the cast strip 21 to hang in a loop beneath the casting rolls in enclosure 27 before the strip passes onto the guide table 30 and engages a succession of guide rollers.

An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations. Additionally, an overflow container may be provided for the distributor 16.

Sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. Sealed, the enclosure 27 and scrap receptacle 26 are filled with a desired gas, such as nitrogen, to reduce the amount of oxygen in the enclosure and provide a protective atmosphere for the cast strip.

Figure 3:
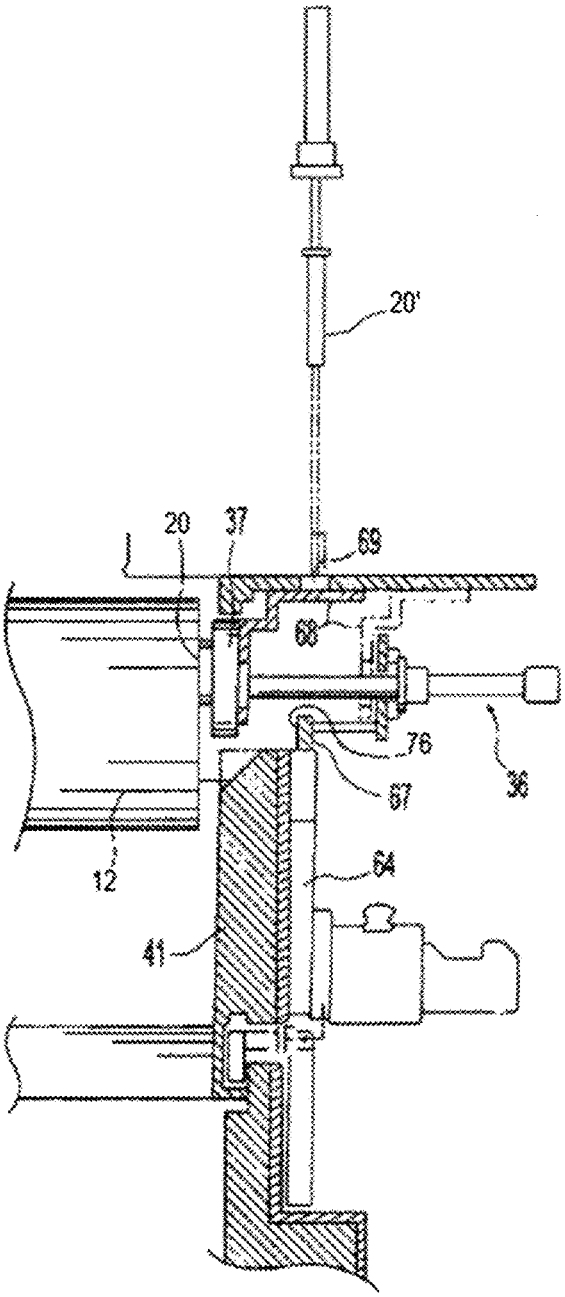
FIGS. 3-5 illustrate various aspects of a continuous twin roll caster system.
Figure 4:
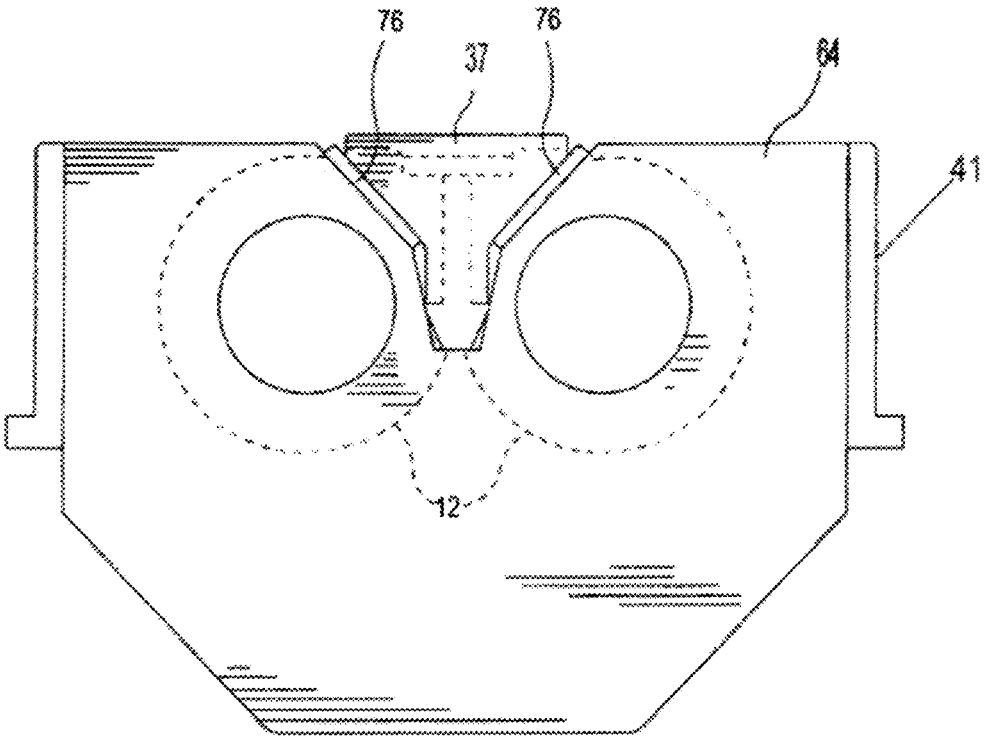
Figure 5:
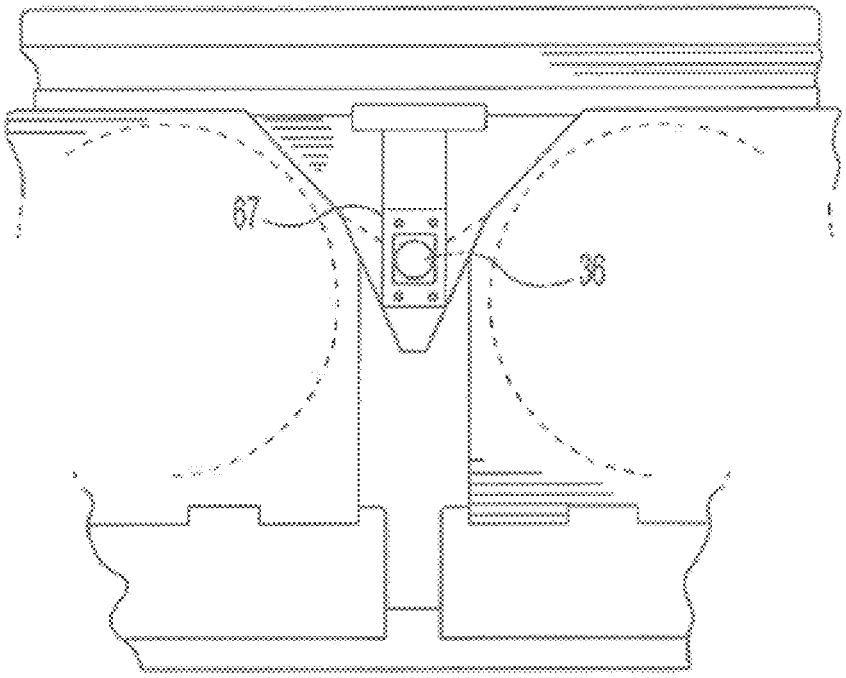

Referring to FIGS. 3-5, the support assembly for the side dams 20 is shown. The first enclosure wall section 41 surrounds the casting rolls 12 and is formed with side plates 64 to support the side dam plate holders 37. The side dams 20 are pressed against the ends portions of casting rolls 12 by the cylinder units 36. The interfaces between the side dam holders 37 and the enclosure side wall sections 41 are sealed by sliding seals 76 to maintain sealing of the enclosure 27 formed by ceramic fiber rope or other suitable sealing material. The cylinder units 36 extend outwardly through the enclosure wall section 41, and at these locations the enclosure is sealed by sealing plates 67 fitted to the cylinder units so as to engage with the enclosure wall section 41 when the cylinder units are actuated to press the pool closure plates against the ends of the casting rolls. Cylinder units 36 also move refractory slides 68 which are moved by the actuation of the cylinder units to close slots 69 in the top of the enclosure, through which the side dams 20 are initially inserted into the enclosure 27 and into the holders 37 for application to the casting rolls. The top of the sealed enclosure 27 is closed by the distributor 16, the side dam holders 37 and the slides 68 when the cylinder units are actuated to urge the side dams 20 against the casting rolls 12.

When it is determined that the side dams 20 need to be changed, typically due to wear, a preheating sequence is commenced. The core nozzle 17 and the distributor 16 are also typically replaced at the same time. This preheating of a second distributor and a second core nozzle is started while casting is continuing at least 2 hours before transfer to the replacement sequence, and the preheating of the second side dams 20' is started at least 0.5 hours before transfer to the replacement sequence. This preheating is done in preheating heaters, typically preheating chambers, in locations convenient to the caster, but removed from the operating position of the refractory components during casting.

During this preheating of the replacement refractory component, casting typically continues without interruption. When the refractory component to be replaced (namely, the distributor 16, the core nozzle 17 and the side dams 20), the slide gate 34 is closed and the distributor 16, the core nozzle 17 and the casting pool 20 are drained of molten metal. Typically, the distributor and side dams are preheated and replaced as individual refractory components, and the core nozzle is preheated and replaced as a singular or two piece refractory component, but in particular embodiments may be preheated and replaced in pieces or parts as those portions of the refractory component are worn or otherwise need to be replaced.

Figure 6:
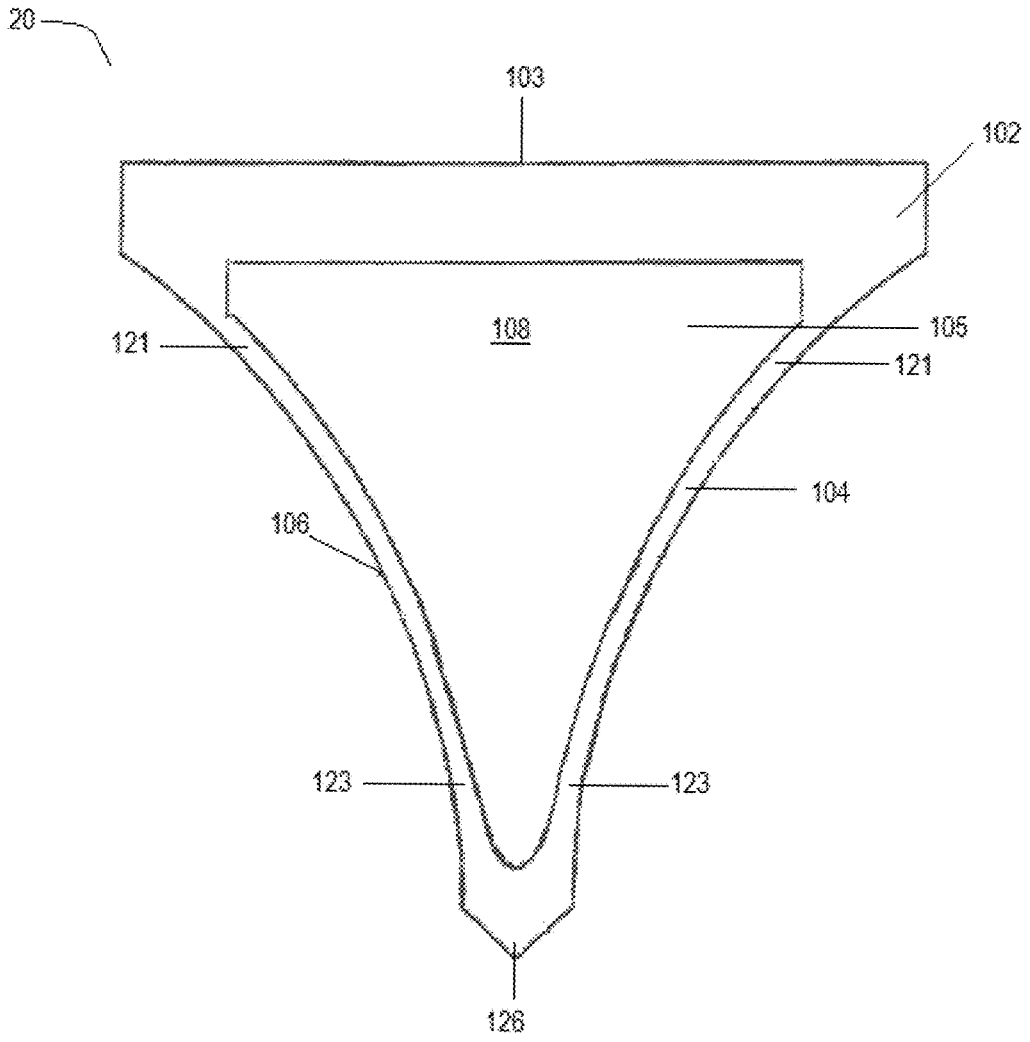
FIG. 6 is a front view of a side dam.

A side dam 20 for the continuous twill roll caster embodying the present invention is shown in FIG. 6. The side dam 20 comprises a body 102 of refractory material shaped to form a side dam. The body 102 has edge portions 106 adapted to engage end portions of casting rolls 12 of the twin roll caster, a nip portion 126 adapted to be adjacent the nip between the casting rolls and has upper portions 103 extending across the side dam to form a lateral restraint for a casting pool of molten metal during operation in a twin roll caster.

The body 102 also has a pocket 105 between 5 and 50 mm in depth formed in the body 102 between the edge portions 106 and forming shoulder portions 104 in the body 102 between the edge portions 106. The shoulder portions 104 are adapted to be worn as a casting campaign continues until the pocket 105 is reached and continuing to be worn away at level of base portions 108 of the pocket 105 until casting is completed. The pocket 105 may be between 5 and 35 mm in depth. Alternatively, the pocket 105 may be between 5 and 25 mm in depth or between 10 and 20 mm in depth. The shoulder portions 104, which start from the edge portions of the body 106 and end at the edge of the pocket 105 may be between 10 and 20 mm in width. Alternatively, the shoulder portions 104 may be between 12 and 18 mm. These widths of the shoulder portions 104 are measured at the upper start of the shoulder portions 104 identified by 121 in FIG. 6 and a location 3 mm up from the bottom of the pocket identified by 123 in FIG. 6. It should be noted that the shoulder portions 104 are typically not the same along their length.

Figure 7:
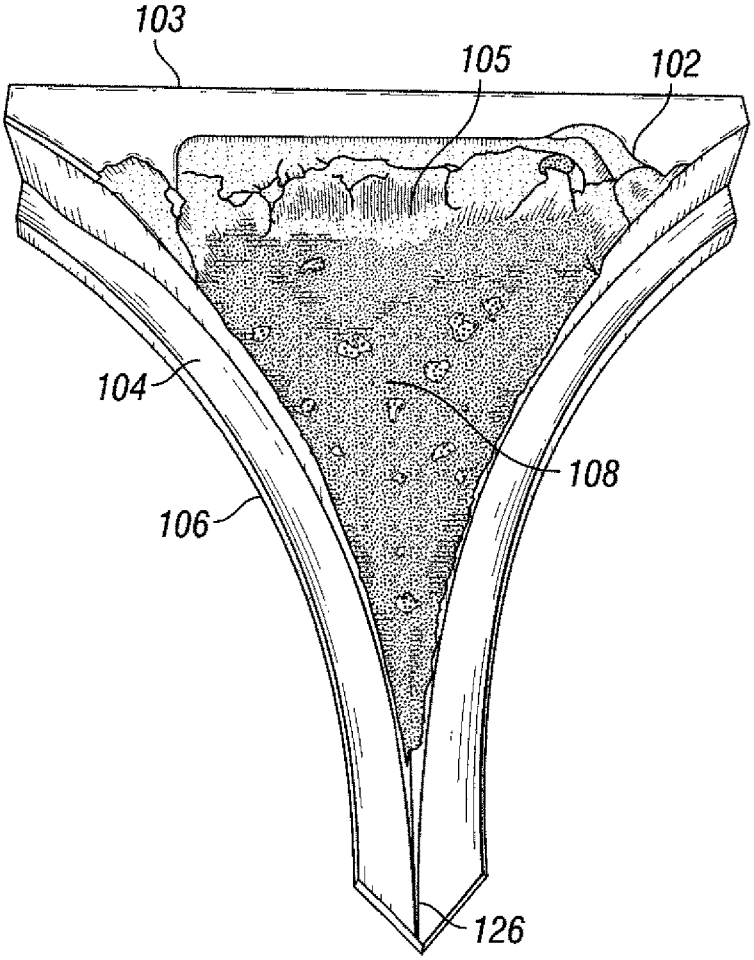
FIG. 7 shows an actual side dam of the present invention after use in a twin roll caster system.

FIG. 7 shows an actual side dam of the present invention after use in a twin roll caster system. As shown, the shoulder portions 104 are adapted to be worn as a casting campaign continues until the pocket 105 is reached and continuing to be worn away at level of base portions 108 of the pocket until casting is completed.

Through testing, we have found that the side dam described above decreases the formation of skulls, and, in turn, snake eggs in the cast strip 21. The presence of skulls is detected by the lateral forces they exert on the casting rolls 12 as they pass between them at the nip 18. Skulls also cause visible bright bands, i.e., snake eggs, to be formed across the width of the strip, which are defects in the surface of the cast strip. During testing, the presence of snake egg forming skulls was monitored by measuring the drive-side (DS) casting roll force (Newtons) and the work-side (WS) casting roll force (Newtons).

Figure 8:
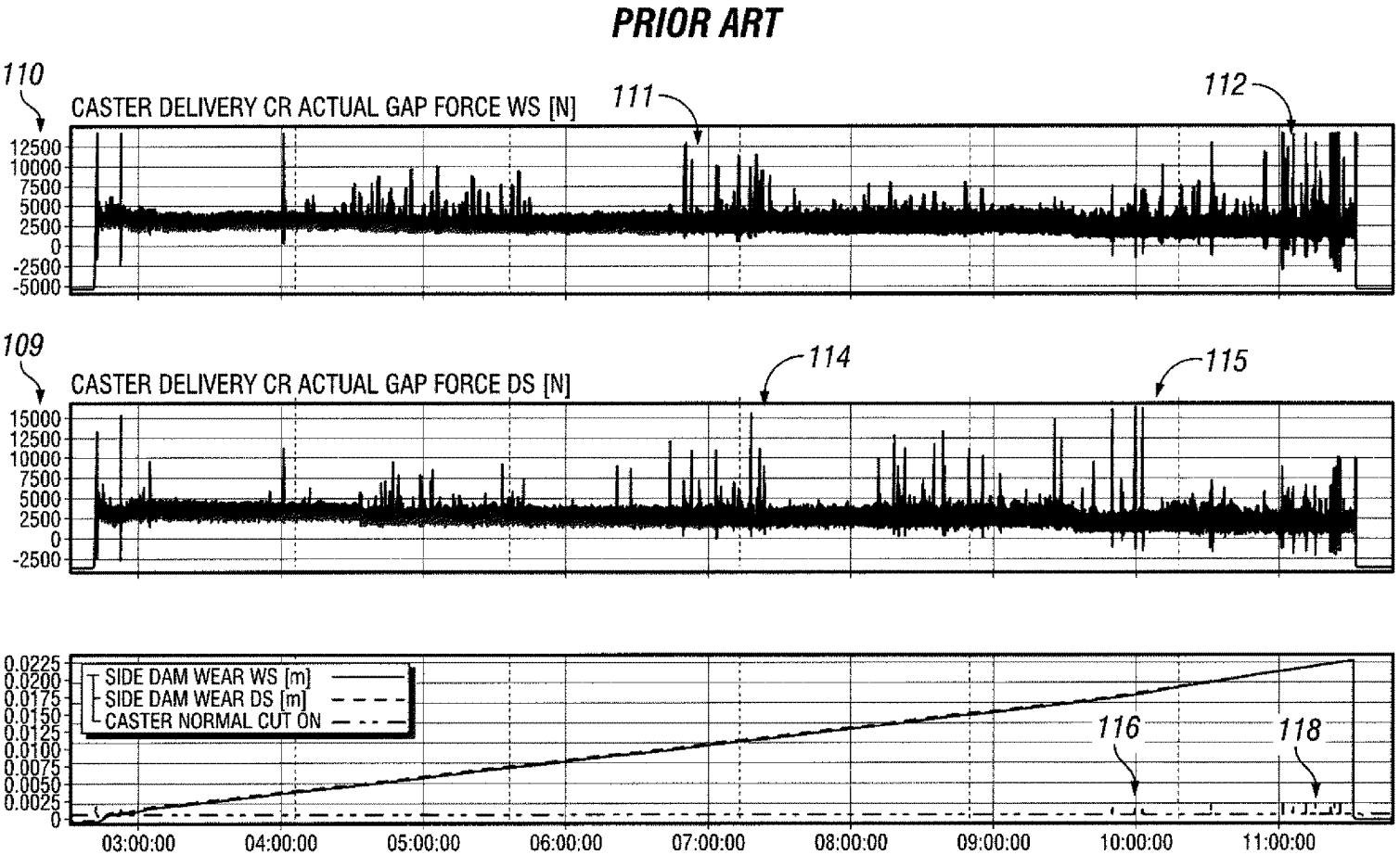
FIG. 8 is a graph showing snake eggs recorded during the casting campaign using previous side dams without pockets.

FIG. 8 sets forth graphs showing the drive-side casting roll for 109 and the work-side casting roll force 110 measured over time when using previous standard side dams. When using previous standard side dams, the drive-side casting roll force 109 showed peaks (e.g. 111, 112) in excess of 12500 N. The work-side casting roll force 110 showed peaks (e.g. 114, 115) in excess of 15000 N. Each peak represents one or more skulls dropping and travelling through the nip of the casting rolls, causing snake eggs, and exerting a lateral pressure on the casting rolls measured by a force detector. When these skulls drop between the roll nip, they may cause the two solidifying shells at the casting roll nip to "swallow" additional liquid metal between the shells, and may cause the strip to reheat and break disrupting the continuous production of casted strip. As illustrated in FIG. 8, multiple strip break peaks (e.g. 116, 118) were observed.

Figure 9:
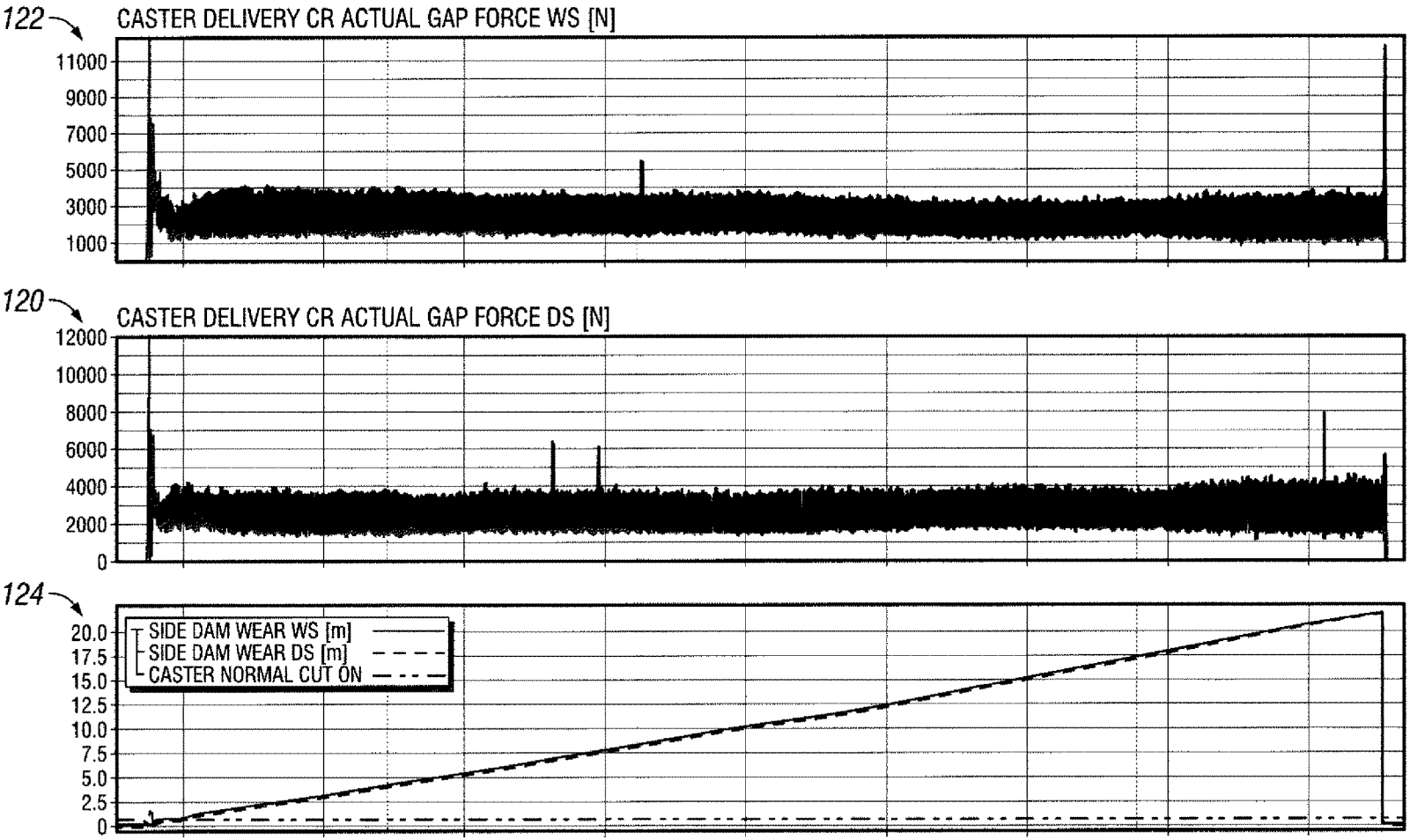
FIG. 9 is a graph showing snake eggs recorded during the casting campaign using side dams with pockets in accordance with this invention.

In contrast, as illustrated in FIG. 9, when the side dams with pockets in accordance with the present invention were used, the incidence and size of peaks indicating snake eggs in both the drive-side casting roll force 120 and the work-side casting roll force 122 were substantially decreased. This indicates that no skulls were formed between the casting rolls and the side dams and therefore no snake eggs were formed in the cast strip. Additionally, as illustrated by the bottom graph 124, no strip breaks were observed.

As seen above, a significant decrease in the amount of skulls and resulting snake eggs was obtained for castings performed with the currently claimed side dam.

While it has been described with reference to certain embodiments, it will be understood by those skilled in the art that various changes may be made and equivalents may be substituted without departing from scope. In addition, many modifications may be made to adapt a particular situation or material to the teachings without departing from its scope. Therefore, it is intended that it not be limited to the particular embodiments disclosed, but that it will include all embodiments falling within the scope of the appended claims.

What is claimed:

1. A side dam for a continuous twin roll caster comprising:

(a) a body of single refractory material shaped to form the side dam and having edge portions adapted to engage end portions of casting rolls of a twin roll caster and having a nip portion adapted to be adjacent a nip between the casting rolls and having upper portions extending across the side dam to form a lateral restraint for a casting pool of molten metal during operation in the twin roll caster; and (b) a pocket arranged along a side of the side dam, the side with pocket being configured to face an interior of the twin roll caster for laterally restraining the casting pool, the pocket being a recess between 5 and 50 mm in depth formed in the body between the edge portions and forming shoulder portions in the body between each of the edge portions and the pocket, the pocket extending into the body from the shoulders, the pocket being configured to engage the casting pool to be confined by the side dam.

2. The side dam for a continuous twin roll caster as claimed in claim 1 where the shoulder portions of the body are between 10 and 20 mm in width.

3. The side dam for a continuous twin roll caster as claimed in claim 1 where the shoulder portions of the body are between 12 and 18 mm in width.

4. The side dam for a continuous twin roll caster as claimed in claim 1 where the pocket is formed in the body between the edge portions between 5 and 35 mm in depth.

5. The side dam for a continuous twin roll caster as claimed in claim 1 where the pocket is formed in the body between the edge portions between 5 and 25 mm in depth.

6. The side dam for a continuous twin roll caster as claimed in claim 1 where the pocket is formed in the body between the edge portions between 10 and 20 mm in depth.

7. The side dam of claim 1, where the pocket is configured to remain unfilled after installation of the side dam in the twin roll caster and prior to operation of the twin roll caster.

8. The side dam of claim 1, where each shoulder portion is adapted to be worn as a casting campaign continues until the pocket is reached and continuing to be worn away at a level of base portions of the pocket until casting is completed.

9. An apparatus for continuously casting metal strip comprising:

(a) a pair of counter-rotatable casting rolls laterally positioned to form a nip there between through which thin strip can be cast;

(b) a pair of confining side dams adjacent the ends of casting rolls adapted to confine a casting pool of molten metal supported on casting surfaces on the casting rolls above the nip, each side dam comprising a body of a single refractory material shaped to form the side dam and having edge portions adapted to engage end portions of the casting rolls and having a nip portion adjacent a nip between casting rolls and having upper portions extending across the side dam to form a lateral restraint for the casting pool of molten metal during operation in a twin roll caster;

(c) each side dam including a pocket arranged along a side of the side dam, the side with pocket being configured to face an interior of the twin roll caster for laterally restraining the casting pool, the pocket being a recess between 5 and 50 mm in depth formed in the body, the pocket being arranged between the edge portions and forming shoulder portions, shoulder portions being arranged between one of the edge portions and the pocket, the pocket extending into the body from the shoulders, the pocket being configured to engage the casting pool to be confined by the pair of side dams; and (d) a metal delivery system disposed above the nip and capable of discharging molten metal to form the casting pool supported on the casting rolls.

10. The apparatus for continuously casting metal strip as claimed in claim 9 where the shoulder portions of the body are between 10 and 20 mm in width.

11. The apparatus for continuously casting metal strip as claimed in claim 9 where the shoulder portions of the body are between 12 and 18 mm in width.

12. The apparatus for continuously casting metal strip as claimed in claim 9 where the pocket is formed in the body between the edge portions between 5 and 35 mm in depth.

13. The apparatus for continuously casting metal strip as claimed in claim 9 where the pocket is formed in the body between the edge portions between 5 and 25 mm in depth.

14. The apparatus for continuously casting metal strip as claimed in claim 9 where the pocket is formed in the body between the edge portions between 10 and 20 mm in depth.

15. The apparatus for continuously casting metal strip of claim 9, where the pocket of each side dam is configured to remain unfilled after installation of the side dam in the twin roll caster and prior to operation of the twin roll caster.

16. The apparatus for continuously casting metal strip of claim 9, where each shoulder portion is adapted to be worn as a casting campaign continues until the pocket is reached and continuing to be worn away at a level of base portions of the pocket until casting is completed.

17. The apparatus for continuously casting metal strip of claim 9, where the interior side of each side dam faces the interior side of the other side dam.

* * * * *